US006458035B1

(12) United States Patent
Katayama

(10) Patent No.: US 6,458,035 B1
(45) **Date of Patent: *Oct. 1, 2002**

(54) METHOD OF MEASURING ROTATIONAL MOTION OF A GOLF BALL

(75) Inventor: Shū Katayama, Saitama (JP)

(73) Assignee: Bridgestone Sports Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/332,137

(22) Filed: Jun. 14, 1999

(30) Foreign Application Priority Data

Jun. 30, 1998 (JP) ..... 10-184718

(51) Int. Cl.[7] ..... G06F 51/00
(52) U.S. Cl. ..... 473/199; 473/198; 473/152
(58) Field of Search ..... 473/199, 140, 473/409, 151–156, 198

(56) References Cited

U.S. PATENT DOCUMENTS 5,471,383 A * 11/1995 Gobush et al. ..... 473/199
5,926,780 A * 7/1999 Fox et al. ..... 473/140
6,042,483 A * 3/2000 Katayama ..... 473/199

FOREIGN PATENT DOCUMENTS

JP 62-104279 5/1987

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

A method of measuring rotational motion of a golf ball. A hit golf ball is photographed by use of two cameras disposed along the traveling direction of the golf ball with a predetermined distance therebetween, and rotational motion of the golf ball is measured based on the photographed images of the golf ball. There is used a golf ball that has a no-depression polygonal mark in black or a dark color close to black printed on the surface of the golf ball. The hit golf ball is photographed by use of two cameras, and the position of an angular point of the no-depression polygonal mark is detected from photographed images, by means of image processing. The rotational motion of the hit golf ball is calculated based on change in position of the angular point in images photographed by the two cameras.

8 Claims, 4 Drawing Sheets

METHOD OF MEASURING ROTATIONAL MOTION OF A GOLF BALL

BACKGROUND OF THE INVENTION

1. Field of the Invention

The present invention relates to a method of measuring rotational motion of a golf ball that moves at an ultrahigh speed, in which method the golf ball is photographed in order to analyze the motion of the golf ball.

2. Description of the Related Art

Conventionally, DINAFAX (trade name) is available on the market as an apparatus for photographing a golf ball in a state in which the golf ball moves at an ultrahigh speed, such as an impact state in which the golf ball receives an impact from a swinging golf club. The DINAFAX has a rotatable cylindrical unit, and a film is disposed on the inner circumferential surface of the cylindrical unit. A lens is provided at a position located away from the center of the cylindrical unit along the axial direction thereof. An image obtained through the lens is projected onto the film through a prism. For high speed photography, the cylindrical unit rotates to thereby sequentially photograph images on the film. Also, Japanese Patent Application Laid-Open (kokai) No. 62-104279 discloses a method which uses a high-speed instantaneous multi-image recording apparatus in combination with a video camera and a strobe.

However, the former method involves the process of developing a film and when the motion of an object to be photographed continuously varies at an ultrahigh speed, whether or not the object has been successfully photographed is unknown until development is completed. Accordingly, re-photographing is often required, in turn requiring much labor and time for experimentation. According to the latter method, the strobe flashes repeatedly to photograph a number of images of a dynamic object within one display area (multi-image photography) while the shutter of the video camera is open. Thus, this method can be carried out only in a dark place (in a place having at most the brightness of a room). Also, the apparatus itself is very expensive.

SUMMARY OF THE INVENTION

The present invention has been accomplished in view of the above problems, and an object of the present invention is to provide a method of measuring rotational motion of a golf ball capable of being carried out both outdoors and indoors through use of a relatively inexpensive apparatus.

To achieve the object, the present invention provides a method of measuring rotational motion of a golf ball in which a hit golf ball is photographed by use of two cameras disposed along the traveling direction of the golf ball with a predetermined distance therebetween, and the rotational motion of the golf ball is measured based on the photographed images of the golf ball. The method comprises the steps of: providing a golf ball having a no-depression polygonal mark in black or a dark color close to black printed on the surface of the golf ball; hitting the golf ball; photographing the hit golf ball by use of two cameras; detecting the position of an angular point of the no-depression polygonal mark from photographed images, by means of image processing (specifically, automatic image processing performed by use of a computer); and calculating rotational motion of the hit golf ball based on change in position of the angular point in images photographed by the two cameras.

As described above, the method of measuring rotational motion of a golf ball according to the present invention enables automatic measurement which can be carried out both outdoors and indoors through use of a relatively inexpensive apparatus.

DESCRIPTION OF THE PREFERRED EMBODIMENT

Figure 1:
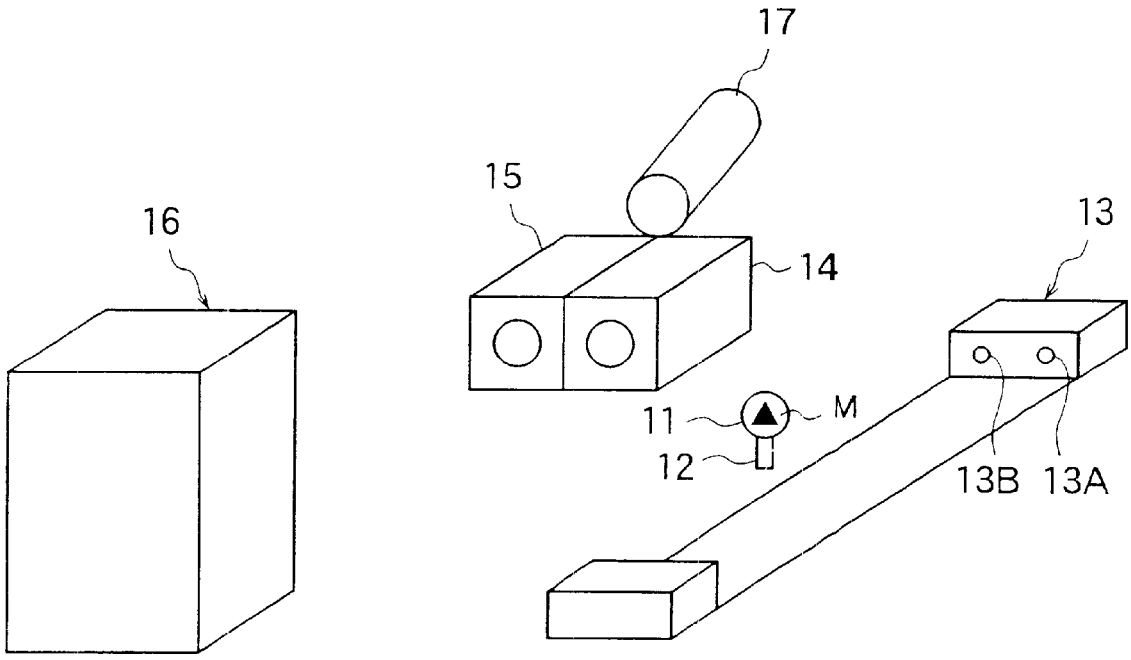
FIG. 1 is a schematic view showing an apparatus which employs a method according to the present invention.

An embodiment of the present invention will now be described with reference to the drawings. FIG. 1 shows an example of an apparatus employing the method of the present invention. The apparatus includes golf ball setting means 12 for setting a golf ball 11 in place; specifically, a tee for placing the golf ball 11 thereon, (hereinafter referred to as a tee 12); sensor means 13 for detecting the passing (downswing) of a club head (not shown) for hitting the ball 11; a first camera 14; a second camera 15; and a control unit 16.

The sensor means 13 is located behind the tee 12 with respect to the travel direction of the ball 11. The first camera 14 and the second camera 15 are disposed ahead of the tee 12 with respect to the travel direction of the ball 11 such that they are located a predetermined distance from the tee 12, are separated from each other, and are aimed horizontally. The control unit 16 has trigger means for sending shutter signals to the respective first and second cameras 14 and 15. When a detection signal is received from the sensor means 13, the trigger means sends shutter signals to the first and second cameras 14 and 15 at a proper timing such that an appropriate time lag is provided between the shutter signals sent to the first and second cameras 14 and 15. Symbol M denotes a mark printed on the surface of the golf ball 11. Before the performance of measurement according to the method of the present invention, the golf ball 11 is set on the tee 12 such that the mark M faces the cameras 14 and 15. The first and second cameras 14 and 15 are preferably CCD cameras having a shutter speed of 1/10,000 to 1/200,000 second.

The sensor means 13 includes a pair of optical sensors, or a first sensor 13A and a second sensor 13B with a distance ml of 70 mm therebetween (see FIG. 2), each composed of a light-emitting element and a light-receiving element. The distance m2 between the tee 12 and the sensor means 13 is preferably approximately 40 mm. The distance m3 between the tee 12 and the first camera 14 preferably ranges from 50 to 300 mm, and the distance m4 between the first and second cameras 14 and 15 preferably ranges from 100 to 250 mm. The positional height of the first and second cameras 14 and 15 with respect to the golf ball 11 (placed on the tee 12) must be determined in consideration of the trajectory of the hit ball 11. According to the specific site where measurement is to be performed, a light 17 may be provided for illuminating the trajectory of the hit ball 11. Also, each of the cameras 14 and 15 may be equipped with a strobe 18 (flashing means) which operates synchronously with the shutter of the camera. The horizontal distance between the trajectory of the hit ball 11 and each of the first and second cameras 14 and 15 is preferably 200 to 600 mm.

The control unit 16, which is connected to the sensor means 13 and the cameras 14 and 15 each equipped with the strobe 18 (specific connections are not illustrated), includes the following:

(1) Control box

The control box includes the following:

a) Frame memory for recording photographed images b) Image analysis unit c) Timing control unit Sensor control, shutter control, I/O (input/output)

d) CPU unit e) FDD (floppy disk drive) and HDD (hard disk drive) or flash memory (2) Software Software for performing the following functions:

a) Calculation and display of head speed, speed of a hit ball, backspin, side spin, and launch angle (upward angle with respect to a horizontal line and sideward angle with respect to a reference line)

b) Calculation of trajectory and travel distance c) Display of the following screens screen divided into some display areas (2 display areas for displaying the image of a ball and 1 display area for displaying measured values)

Launch angle distribution screen

Carry and/or total distance distribution screen

Trajectory screen d) Accumulation of data (3) Monitor and printer

Figure 2:
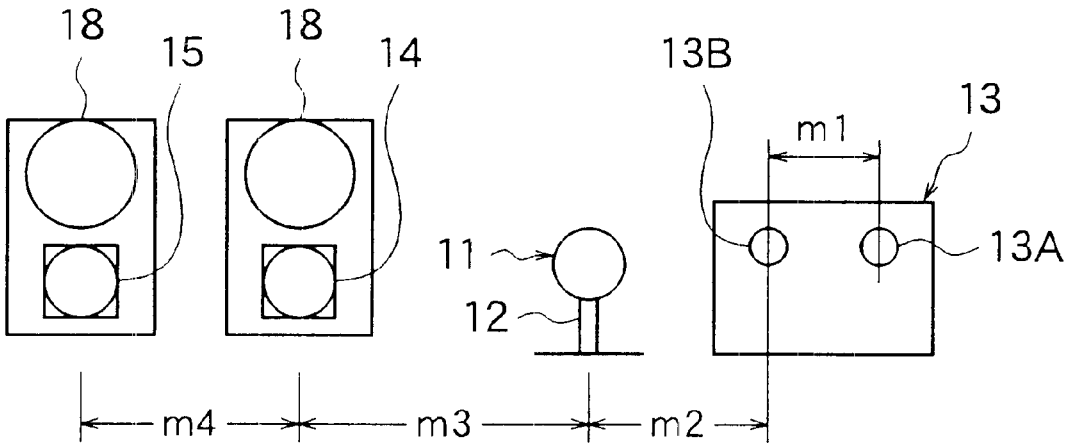
FIG. 2 is a view showing an arrangement of components of the apparatus shown in FIG. 1.
Figure 3:
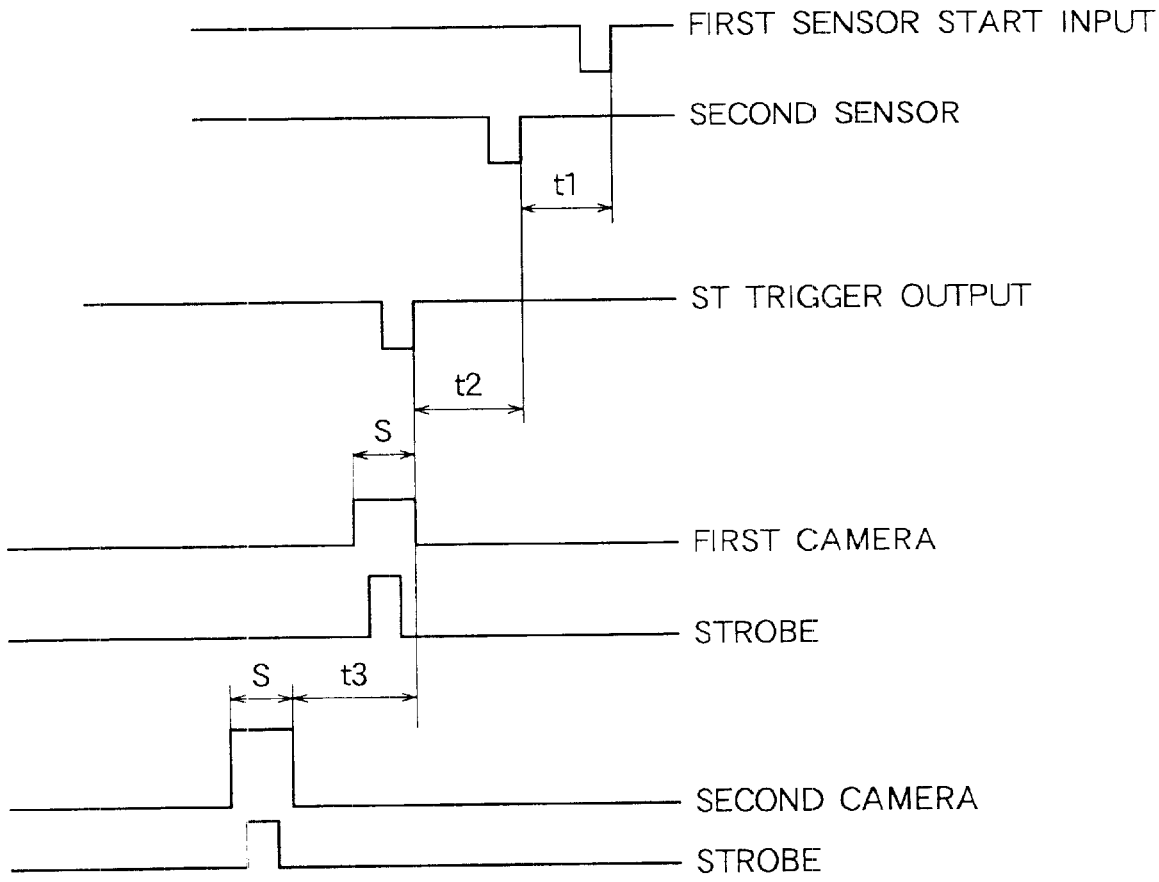
FIG. 3 is a time chart showing an operation of the apparatus shown in FIG. 1.

Next, the method will be described with reference to FIGS. 2 and 3. When the first and second sensors 13A and 13B detect the passing of a golf club head, the control unit 16 calculates time t1 required for the club head to pass between the sensors. Based on the measured time t1 and the distance between the sensors 13A and 13B, the control unit 16 calculates a head speed. Upon reception of a detection signal from the second sensor 13B, the control unit 16 outputs a trigger signal to each of the cameras 14 and 15 and to each of the strobes 18. In the present embodiment, a plurality of head speeds is previously measured. During operation, a delay time t2 and shutter intervals t3 are previously set in accordance with an applicable head speed selected from the previously measured head speeds.

Figure 4:
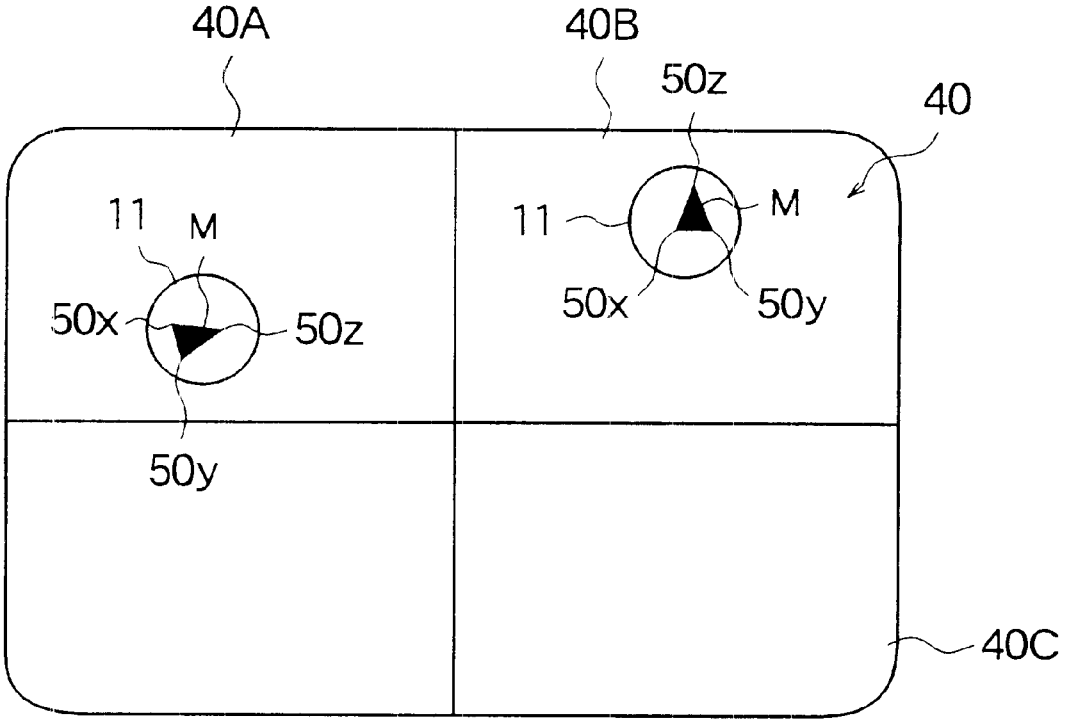
FIG. 4 is a view showing a monitor screen.

FIG. 4 shows the monitor screen of the control unit 16 on which images of the hit ball 11 are displayed. The monitor screen 40 is divided into four display areas. A first display area 40A displays the side view of the hit ball 11 as obtained through the first camera 14. A second display area 40B displays the side view of the hit ball 11 as obtained through the second camera 15. A third display area 40C displays measured values.

In the present invention, the shape of the mark M printed on the golf ball 11 is a no-depression polygon. The term "no-depression polygon" refers to a polygon in which none of the sides passes through the interior of the polygon, when the side is extended. In the present invention, the no-depression polygon is preferably an isosceles triangle. The mark M is painted in black or any dark color close to black in order to make it contrast well with the color of the surface of the golf ball.

If the shape of the mark is an isosceles triangle, the ratio between the length of the base and the altitude is within the range of 1:1 to 1:3, more preferably around 1:1.5. If the ratio of the altitude to the length of the base is so small that the shape of the mark is close to an equilateral triangle, the three angular points of the triangle become difficult to distinguish from one another. In contrast, if the ratio of the altitude to the length of the base is excessively large, the length of the base becomes small relative to the diameter of the golf ball, resulting in difficulty in image processing. The length of the base is preferably 6–15 mm, more preferably about 10 mm. If the length of the base is less than 6 mm, image processing becomes difficult due to dimples formed on the surface of the golf ball (that is, processing an image formed on dimples becomes difficult). If the length of the base exceeds 15 mm, the altitude increases accordingly, resulting in an excessively large mark. In this case, if the amount of side spin is large in a hit ball, a portion of the mark easily becomes invisible to the cameras.

In the present embodiment, the golf ball 11 is displayed in white against a black background, and the profile of the golf ball 11 is extracted from each of the images displayed on the first and second display areas 40A and 40B (FIG. 4), through use of a digitization (white/black) technique. Next, the mark M is extracted from an area inside the profile of the golf ball 11 through use of a similar digitization technique. In some cases, a dimpled portion inside the mark M is displayed in white due to the reflection of light. In such cases, image processing (blackening) is performed to blacken such a whitened portion.

After completion of the above-described procedure, the main axis (the median joining the midpoint of the base and the vertex) of the mark M is obtained. From this main axis, searching is performed outwardly along directions perpendicular to the main axis in order to detect a point where the color changes from black to white. This searching procedure is performed along the main axis. As a result, two straight lines each passing through the thus-searched locus of the color-change points, i.e., two legs of the triangular mark are obtained. Next, straight lines are defined outside the black mark such that the straight lines perpendicularly intersect the center pints of the legs of the triangular mark. From these straight lines, searching is performed toward the black mark to detect the base of the triangular mark. The legs and base are preferably obtained through curve approximation in consideration of the curvature of the spherical surface of the golf ball.

After identification of the triangle, i.e., the mark M through image processing, the three angular points 50$x$, 50$y$, and 50$z$ of the triangle are obtained based on the three sides. The three-dimensional vector of each of the three angular points 50$x$, 50$y$, and 50$z$ is obtained based on images appearing in the first and second display areas 40A and 40B with the ball 11 taken as a unit ball having a radius of 1. Based on the movement of the ball 11 from its position in the first display area 40A to that in the second display area 40B, the vector of the rotational axis of the ball 11 is obtained. Through vector analysis of the thus-obtained three-dimensional vector(s) of the point(s) and the thus-obtained vector of the rotational axis, the amount of rotation of the ball 11 is obtained. Based on the vector of the rotational axis and the thus-obtained amount of rotation, the amounts of backspin and side spin of the ball 11 can be obtained. Also, a difference in vertical position of the golf ball 11 between the first display area 40A and the second display area 40B (FIG. 4) is measured. Then, based on the thus-measured difference in vertical position and the distance m4 (horizontal distance), the upward launch angle of the ball 11 can be obtained.

Through use of CCD cameras having a shutter speed of 1/10,000 to 1/200,000 as the cameras 14 and 15 in combination with respective strobes which operate synchronously with the cameras, an image of a white golf ball is displayed in the black background regardless of whether the method of the present invention is carried out indoors or outdoors. Also, a no-depression polygonal mark printed on a ball is also clearly displayed in black. The movement of a certain point(s) on the mark appearing on a golf ball image is automatically obtained on a computer through use of an image-analyzing technique such as a digitization technique to thereby calculate the amount of spin of a golf ball. Likewise, through the computer image analysis using a digitization technique or the like, the launch angle of a golf ball can be calculated. Accordingly, rotational motion of a golf ball can be analyzed efficiently and accurately.

As described above, the present embodiment carrying out the method of the present invention comprising the steps of: detecting by sensor means the passing of a club head to hit a ball set at a predetermined position; sending a detection signal from the sensor means to trigger means of a control unit; and in response to the detection signal, sending shutter signals from the trigger means to respective first and second cameras at a proper timing, while providing an appropriate time lag between the shutter signals, so as to photograph the hit golf ball through the first and second cameras, the first and second cameras facing horizontally, apart from each other, and away from the set position of the ball at a predetermined distance. According to the present invention, in order to calculate the carry of a hit ball and to simulate the trajectory of a hit ball, only the velocity of the hit ball, the angle of hit, and the amount of backspin are measured as initial conditions by means of the horizontally facing first and second cameras. Thus, this system for measuring rotational motion of a golf ball can be realized in a relatively simple configuration and at low cost. Also, the operation is simple. Further, the system highly facilitates the improvement of the swinging form of a golfer, the development of golf balls, and the evaluation of performance of golf balls. For example, a certain kind of ball may be tested through use of different kinds of golf clubs to thereby evaluate the performance of the golf clubs.

What is claimed is:

1. A method of measuring rotational motion of a golf ball in which a hit golf ball is photographed by use of a first camera and a second camera disposed along the traveling direction of the golf ball with a predetermined distance therebetween, and the rotational motion of the golf ball is measured based on the photographed images of the golf ball, said method comprising the steps of:

providing a golf ball having a no-depression polygonal having an isosceles triangle mark in black or a dark color close to black printed on the surface of the golf ball, the ratio between the length of the base and the altitude of the isosceles triangle is within the range of 1:1 to 1:3 and the length of the base of the isosceles triangle is 6–15 mm;

hitting a golf ball;

sensing the downswing of the club head preceding said hitting step whereupon a detection signal is output;

photographing the hit golf ball on the trajectory of travel thereof by use of said first camera and the second camera wherein the first camera takes a first photograph of the golf ball in front of the first camera and the second camera takes a second photograph of the golf ball in front of the second camera, respectively;

detecting the position of each angular point of the isosceles triangle mark from photographed images by means of image processing; and calculating the rotational motion of the hit golf ball based on change in position of each of the angular points of the marks in images photographed by the first camera and the second camera.

2. A method according to claim 1, wherein the images photographed by the first camera and the second camera are displayed in a first display area and a second display area of a monitor screen, respectively.

3. A method according to claim 1, wherein calculating said rotational motion of the hit golf ball a three-dimensional vector of each of angular points is obtained based on the photographed images of the golf ball taken as a unit having a radius of 1.

4. A method according to claim 3, wherein the vector of the rotational axis of the golf ball is obtained based on the movement of the golf ball from its position in the first photographed image to the second photographed image.

5. A method according to claim 4, wherein an amount of rotation of the golf ball is obtained based on vector analysis of the three-dimensional vector of the point and the vector of the rotational axis.

6. A method according to claim 5, wherein amounts of backspin and side spin of the golf ball are obtained based on a vector of the rotational axis and an amount of rotation.

7. A method according to claim 1, wherein an upward launch angle of the golf ball is obtained based on a difference in vertical position of the golf ball between the first image by the first camera and the second image by the second camera and a distance between the positions of the first camera and the second camera.

8. A method according to claim 1, wherein the timing of said photographing step is responsive to said detection signal.

* * * * *